US008657385B2

(12) United States Patent
Fader et al.

(10) Patent No.: US 8,657,385 B2
(45) Date of Patent: Feb. 25, 2014

(54) CARBIDE BLOCK AND SLEEVE WEAR SURFACE

(75) Inventors: Joseph Fader, Abingdon, VA (US); Kenneth Monyak, Abingdon, VA (US); Daniel Mouthaan, Williamsburg, MI (US); Joseph J. Redman, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 282 days.

(21) Appl. No.: 12/993,666

(22) PCT Filed: Apr. 30, 2009

(86) PCT No.: PCT/SE2009/050469

§ 371 (c)(1),
(2), (4) Date: Jun. 24, 2011

(87) PCT Pub. No.: WO2009/142577

PCT Pub. Date: Nov. 26, 2009

(65) Prior Publication Data

US 2011/0241407 A1 Oct. 6, 2011

Related U.S. Application Data

(60) Provisional application No. 61/054,500, filed on May 20, 2008.

(51) Int. Cl.
*E21C 35/183* (2006.01)

(52) U.S. Cl.
USPC ..... 299/104; 299/113; 299/107

(58) Field of Classification Search
USPC ..... 299/104, 106, 107, 113
See application file for complete search history.

(56) References Cited

U.S. PATENT DOCUMENTS

| | | | | |
|---|---|---|---|---|
| 3,807,804 | A * | 4/1974 | Kniff | 299/113 |
| 4,932,723 | A | 6/1990 | Mills | |
| 5,251,964 | A * | 10/1993 | Ojanen | 299/104 |
| 6,585,327 | B2 * | 7/2003 | Sollami | 299/107 |
| 7,097,257 | B2 | 8/2006 | Stehney | |
| 7,234,782 | B2 | 6/2007 | Stehney | |
| 2011/0204702 | A1 * | 8/2011 | Lehnert et al. | 299/105 |

FOREIGN PATENT DOCUMENTS

| | | |
|---|---|---|
| DE | 42 04 542 | 9/1992 |
| DE | 196 30 653 | 4/1998 |
| DE | 19821147 | 11/1999 |
| EP | 0 413 917 | 6/1990 |

* cited by examiner

*Primary Examiner* — John Kreck
(74) *Attorney, Agent, or Firm* — Morgan, Lewis & Bockius LLP

(57) ABSTRACT

An assembly is disclosed including a holder block, a cutting pick, and an optional hollow sleeve, wherein the shank of the cutting pick is inserted into the holder block or, where present, into the hollow sleeve. When assembled, surfaces of the components meet at an interface. At least one of the first interface and the second interface includes one or more sets of wear elements including cemented carbide bodies press fit into recesses in the forwardly oriented surfaces meeting at the interfaces. The wear elements mitigate direct contact between the opposing surfaces of the components at the interfaces and prevents excessive wear from repetitive impact because the harder wear elements, e.g., cemented carbide, are contact points between the opposing surfaces of the components at the interfaces. A machine incorporating the assembly and a method of manufacturing the assembly are also disclosed, particularly a machine for mining, excavating, tunneling, road planing and/or construction.

15 Claims, 5 Drawing Sheets

CARBIDE BLOCK AND SLEEVE WEAR SURFACE

CROSS REFERENCE TO RELATED APPLICATIONS

This application is the National Stage of International Application No. PCT/SE2009/050469, filed Apr. 30, 2009, and claims benefit of U.S. Application No. 61/054,500, filed May 20, 2008, both of which are herein incorporated by reference in their entirety.

FIELD

The present disclosure relates to a block and sleeve assembly for holding a tool pick. More particularly, the present disclosure relates to a cemented carbide wear surface at forward facing surfaces at the interface of the pick shoulder and the corresponding block or sleeve face and/or at the interface of the sleeve shoulder and the corresponding block face. The disclosure also relates to a machine incorporating such a block and sleeve assembly and to a production method, particularly machines for mining, excavating, tunneling, road planing and/or construction.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Typical block and sleeve assemblies have a block body with a bore therethrough from a front face to a rear face. A shaft of a tool pick is placed into the bore, either directly or with an intermediate sleeve. The tool pick has a shoulder that, in some instances, contacts the front face of the block. When present, the tool pick shoulder contacts the front face of the sleeve. Examples of blocks and/or block and sleeve assemblies are disclosed in U.S. Pat. No. 7,097,257; U.S. Pat. No. 7,234,782; U.S. Pat. No. 5,251,964; DE 4 204 542; DE 196 30 653; and DE 198 21 147, the entire contents of each are incorporated herein by reference.

Existing holder systems are prone to failure due to the excessive wear from repetitive impact of the pick shoulder against the block or sleeve face. These impacts cause deformation of the block or sleeve face. The deformation is in the form of a depression or indentation in the face, which results in more axial movement of the pick. As the axial movement increases, the deformation is accelerated. When the movement of the pick is too great, the block or sleeve must be replaced.

Another common wear issue on existing holder systems is frictional wear. As picks cut, abrasive fines that become trapped between their shoulders and the block or sleeve face erode the surface of the holder. This also shortens the life of the holder system.

U.S. Pat. No. 6,585,327 discloses a carbide ring that extends into the bore of a block or sleeve. As the pick strikes the material being cut, the pick shank is driven against the wall of the carbide ring. Cemented carbide has excellent compressive strength but weak tensile strength. When a shank is repeatedly driven into the wall of the carbide ring, it creates tensile loading that cause the carbide ring to fracture. Subsequent fractures result in the deterioration of the ring, rendering it ineffective.

SUMMARY

An exemplary assembly comprises a holder block having a first bore extending rearwardly from a forwardly oriented front face, a cutting pick including a cutting head at a front end with a cutting tip, a shank at a rear end and a shoulder at a transition between the front end and the shank, the shoulder including a rearwardly oriented surface, and a hollow sleeve mounted in the first bore of the holder block to receive the shank of the cutting pick, the hollow sleeve including, at a forward end, a forwardly oriented face and a radially extending shoulder with a rearwardly oriented surface and, at a rearward end, a shank defining a longitudinal axis, wherein the shank of the cutting pick is inserted into the hollow sleeve, wherein the front face of the holder block and the rearwardly oriented surface of the shoulder of the hollow sleeve meet at a first interface and the forwardly oriented face of the hollow sleeve and the rearwardly oriented surface of the shoulder of the cutting pick meet at a second interface, and wherein at least one of the first interface and the second interface includes a plurality of wear elements press fit into recesses in the forwardly oriented face.

Another exemplary assembly comprises a holder block having a first bore extending rearwardly from a front face, a cutting pick including a cutting head at a front end with a cutting tip, a shank at a rear end and a shoulder at a transition between the front end and the shank, the shoulder including a rearwardly oriented surface, and a first cemented carbide wear element press fit into a first recess in the front face of the holder block, wherein the shank of the cutting pick is inserted into the first bore of the holder block to mount the cutting pick in the holder block, and wherein the front face of the holder block and the rearwardly oriented surface of the shoulder meet at an interface.

An exemplary method of manufacturing an assembly comprises forming a holder block having a first bore extending rearwardly from a front face, forming a cutting pick including a cutting head at a front end with a cutting tip, a shank at a rear end and a shoulder at a transition between the front end and the shank, the shoulder including a rearwardly oriented surface, forming a hollow sleeve mounted in the first bore of the holder block to receive the shank of the cutting pick, the hollow sleeve including, at a forward end, a radially extending shoulder with a forwardly oriented face and a rearwardly oriented surface and, at a rearward end, a shank defining a longitudinal axis; and at least one of (a) press fitting a first set of wear elements including cemented carbide bodies into recesses in a front face of the holder block, and (b) press fitting a second set of wear elements including cemented carbide bodies into recesses in one a forwardly oriented face of the hollow sleeve.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1A:
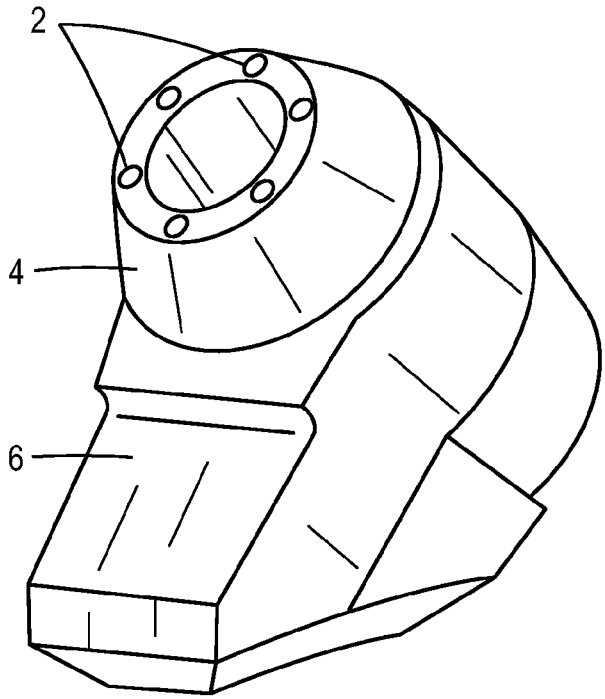
FIGS. 1A to 1C illustrate several exemplary embodiments of an assembly showing a holder block and, in FIG. 1A, a hollow sleeve with wear elements in the forwardly facing surfaces.
Figure 1B:
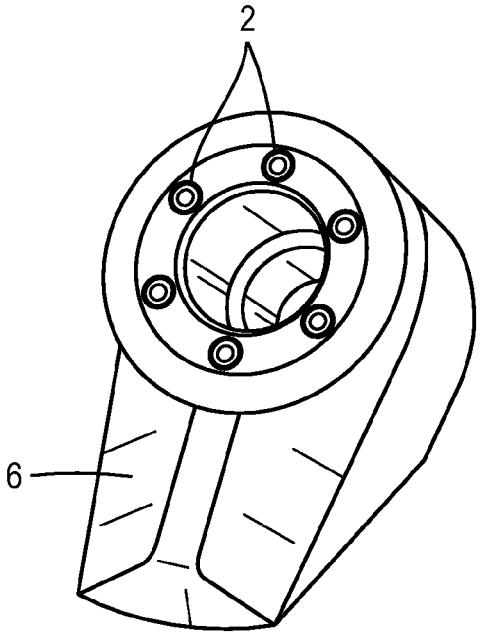
Figure 1C:
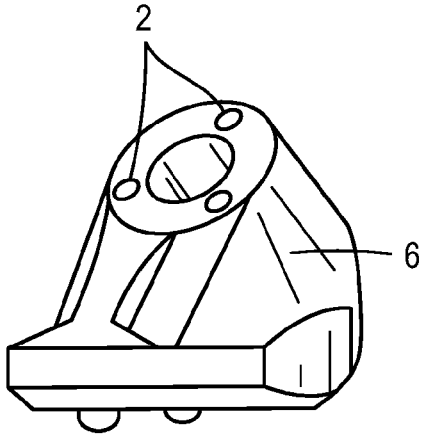

FIGS. 1A to 1C illustrate several exemplary embodiments of an assembly showing a holder block and, in FIG. 1A, a hollow sleeve with wear elements in the forwardly facing surfaces. In FIG. 1A, wear elements 2 are seen in the front face of the hollow sleeve 4, which itself is mounted in a holder block 6. In FIGS. 1B and 1C, two different types of wear elements 2 are seen in the front face of the holder block 6—circumferentially positioned rings in FIG. 1B and solid buttons in FIG. 1C.

Figure 2:
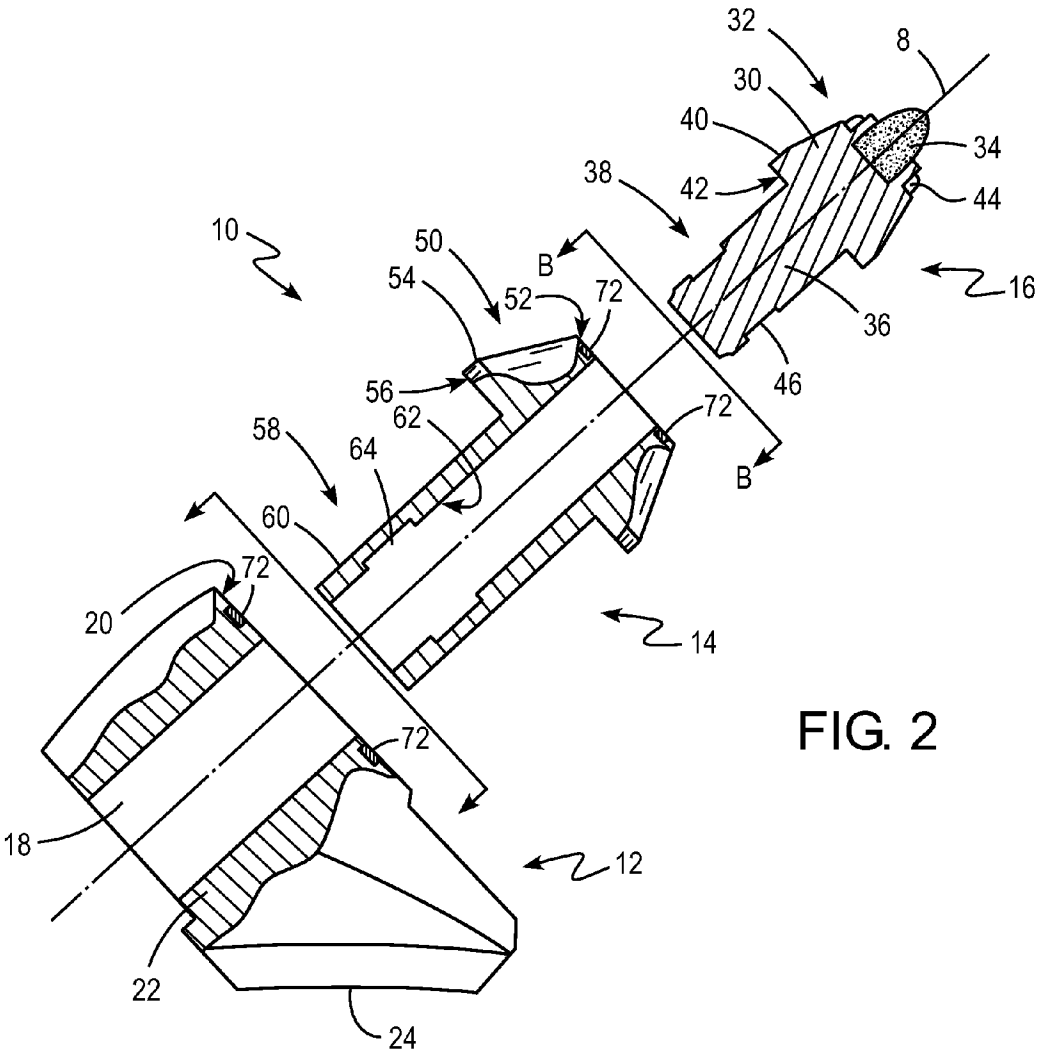
FIG. 2 is an exploded partial cross-sectional view of an exemplary embodiment of an assembly showing a holder block, a hollow sleeve and a cutting pick.

FIG. 2 is an exploded partial cross-sectional view of an exemplary embodiment of an assembly 10 showing a holder block 12, a hollow sleeve 14 and a cutting pick 16. The partial cross-sectional view is provided to better illustrate the features of the holder block 12, the hollow sleeve 14 and the cutting pick 16 that occur at the areas where the individual components meet when assembled, i.e., at the interface. The components are arranged in exploded view along axis 8.

The holder block 12 can be any suitable holder block. In the exemplary embodiment, the holder block 12 has a first bore 18 extending rearwardly from a front face 20. The first bore 18 can extend completely through the body 22 of the holder block 12, or can extend partially through the body 22. A base surface 24 of the holder block 12 is adapted for mounting on a rotatable element of a machine for the mining, excavating, tunneling, road planing and/or construction (not shown), such as an Alpine Miner mining machine available from Sandvik AB.

The cutting pick 16 can be any suitable cutting pick. In an exemplary embodiment, the cutting pick 16 includes a cutting head 30 at a front end 32 with a cutting tip 34, a shank 36 at a rear end 38 and a shoulder 40 at a transition between the front end 32 and the shank 36. The shoulder 40 includes a rearwardly oriented surface 42. Other features of the illustrated cutting pick 16 include a carbide ring 44 or a material deflection ledge toward the front end 32 and a groove 46 on the shank 36. The groove 44 can conventionally accommodate a compression ring or other retaining device (shown in FIG. 2) to assist with retaining the cutting pick 16 in the hollow sleeve 14 while allowing rotation of the cutting pick 16. However, other types of retaining methods can be used, including non-rotating retaining methods such as an interference fit.

The hollow sleeve 14 can be any suitable hollow sleeve. In an exemplary embodiment, the hollow sleeve 14 is mounted in the first bore 18 of the holder block 12. Mounting of the sleeve 14 in the first bore 18 can be by any suitable means. In an exemplary embodiment, the sleeve is mounted by an interference fit. In another exemplary embodiment, the sleeve is mounted by a retaining device, such as a retaining clip. At a forward end 50, the hollow sleeve 14 includes a forwardly oriented face 52 and a radially extending shoulder 54 with a rearwardly oriented surface 56. At a rearward end 58, the hollow sleeve 14 includes a shank 60 defining a longitudinal axis. The hollow sleeve 14 receives the shank 36 of the cutting pick 16. Where a compression ring or other shank mounted retaining device (not shown) is used to assist with retaining the cutting pick 16 in the hollow sleeve 14, the inner diameter surface 62 of the hollow sleeve 14 can include a groove 64 to accommodate such compression ring or other retaining device. Alternatively, the shank 36 of the cutting pick 16 can extend past the rearward end 58 to accommodate an rearward shank retaining device, such as an external clip.

Figure 3:
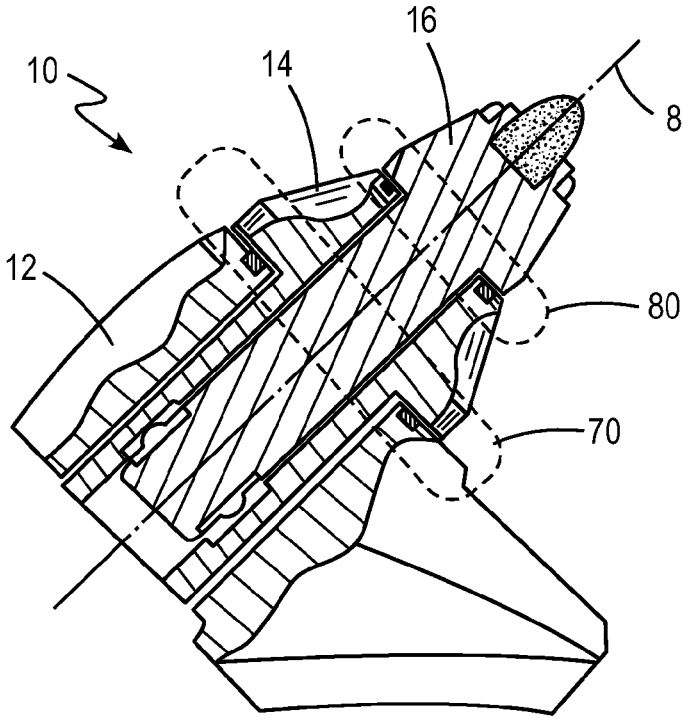
FIG. 3 shows the individual components when assembled together.

The areas where the individual components meet when assembled together along axis 8 are denoted in FIG. 3, which shows a first interface 70 and a second interface 80. At the first interface 70, the front face 20 of the holder block 12 and the rearwardly oriented surface 56 of the shoulder 50 of the hollow sleeve 14 meet. The forwardly oriented face 54 of the hollow sleeve 14 and the rearwardly oriented surface 42 of the shoulder 40 of the cutting pick 16 meet at a second interface 80.

At least one of the first interface 70 and the second interface 80 includes a plurality of wear elements 72. The wear elements 72 are press fit into recesses in the forwardly oriented faces. For example, at least one, or alternatively both, of the front face 20 of the holder block 12 and the forwardly oriented face 52 of the hollow sleeve 14 include the press fit wear elements 72. The wear elements directly contact an opposing surface of an adjoining component, e.g., a rearwardly facing surface. The wear elements mitigate direct contact between the opposing surfaces of the components at the interfaces and prevent excessive wear from repetitive impact because the harder wear elements, e.g., cemented carbide, are contact points between the opposing surfaces of the components at the interfaces.

Figure 4:
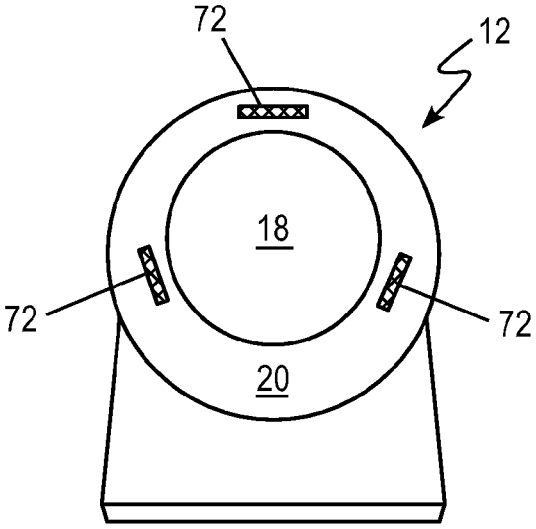
FIG. 4 is a view of the front face of the holder block as seen from A-A in FIG. 2.
Figure 5:
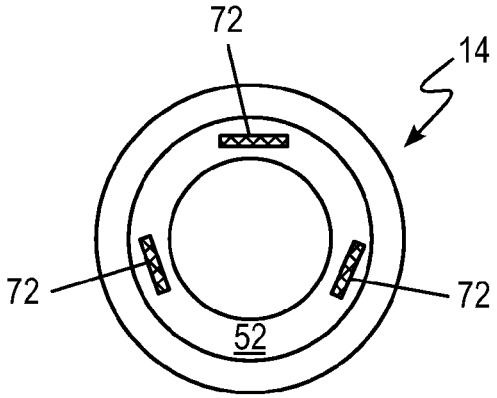
FIG. 5 is a view of the rearwardly oriented surface of the shoulder of the hollow sleeve as seen from B-B in FIG. 1.
Figure 6:
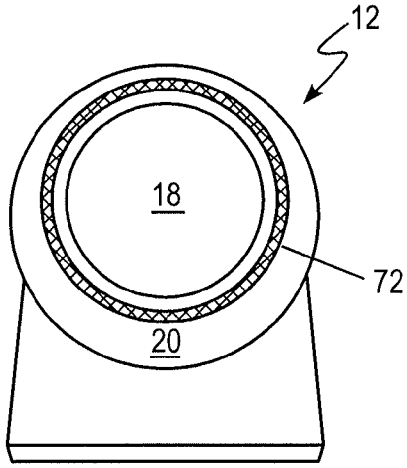
FIGS. 6-10 variously illustrate exemplary embodiments of alternative embodiments of the wear elements.
Figure 8:
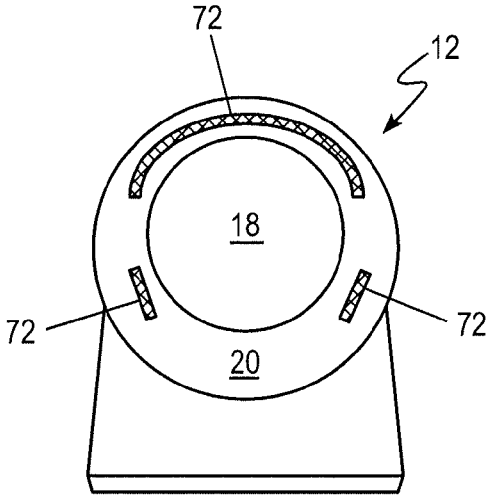
Figure 7:
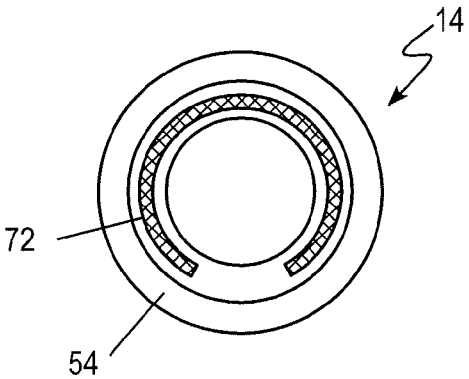
Figure 9:
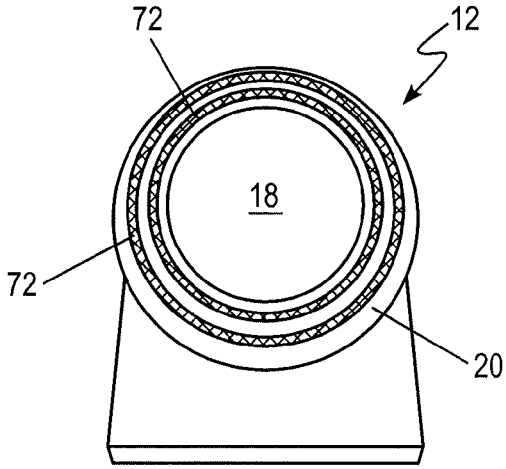
Figure 10:
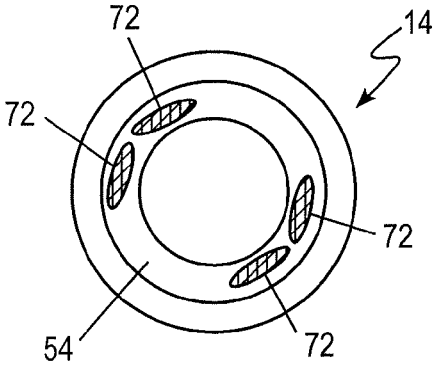

FIGS. 4-5 show exemplary embodiments of the wear elements. FIG. 4 is a view of the front face 20 of the holder block 12 as seen from A-A in FIG. 2. FIG. 5 is a view of the forwardly oriented face 52 of the hollow sleeve 14 as seen from B-B in FIG. 2. In FIGS. 4-5, the wear elements 72 are discreet components arranged circumferentially on the front face 20, for example, about an opening such as for the holder block the bore 18.

In an exemplary embodiment, the wear elements are cemented carbide. The wear elements are press fit into recesses in the respective surfaces of the interfaces. In an exemplary embodiment, press fitting includes heating the area of the recess to expand the size of the recess, inserting into the heated recess a wear element that is oversized relative to a room temperature size of the recess, and allowing the area of the recess to cool and contract, thereby providing a press fit that retains the wear element in the recess. Subsequent to press fitting the wear elements into the recesses, the components, e.g., at least one of the holder block and the hollow sleeve, can be heat treated without detrimental effect to the press fit mounting. In conventional brazed systems, subsequent heat treatment was limited if not avoided because the elevated temperatures during the heat treatment detrimentally effected the braze. Alternatively, once heat treated subsequent brazing causes annealing of the heat treated material in the area of the braze.

Although the figures show wear elements on each of the eligible surfaces of both the first interface 70 and the second interface 80, such arrangement is illustrative and different combinations of forwardly oriented surfaces and locations on the forwardly oriented surfaces can have the wear elements. For example, only one of the surfaces at each interface can have the wear elements, or only one interface can have the wear elements, or only one surface of one interface can have the wear elements. Also for example, the wear elements can be circumferentially spaced and the type and number of wear elements can vary between the interfaces.

For example, the wear elements can include a plurality of discreet wear elements, such as those illustrated in FIGS. 4-5; alternatively, larger wear elements and other geometries can be used than those illustrated in FIGS. 4-5, up to and including partial rings and full 360 degree rings that are press fit into a corresponding groove in the components. FIGS. 6-10 variously illustrate exemplary embodiments of alternative embodiments of the wear elements 72. These alternative embodiments, shown variously press fit into the front face 20 of the holder block 12 or press fit into the forwardly oriented face 52 of the hollow sleeve 14, include full rings (FIG. 6), partial rings (FIGS. 7 and 8), a plurality of individual full rings (FIG. 9) or individual partial rings (not shown), and a plurality of oblong shapes (FIG. 10) or other geometric shapes. In an exemplary embodiment, the number of wear elements is greater than or equal to three, alternatively three to nine, further alternatively six.

Although shown on specific components, the wear elements 72 in FIGS. 4-10 can be used on any of the components. It is to be understood that these various embodiments can also be used in either of the front face 20 of the holder block 12 or the forwardly oriented face 52 of the hollow sleeve 14 and that the embodiment of the wear element 72 in the front face 20 does not have to be the same as the embodiment of the wear element 72 in the forwardly oriented face 52. In addition, although wear elements are shown 180 degrees apart in FIGS. 2 and 3, the wear elements can be arranged at other orientations, such as the 120 degree separation illustrated in FIGS. 4-5, or symmetric or asymmetric arrangements, as long as the wear elements are positioned to mitigate direct contact between the opposing surfaces of the components at the interfaces and to prevent excessive wear from repetitive impact. Over time, the steel body erodes and the wear elements, or an area of the surface including the wear elements and surrounding material, project beyond the worn surface.

Figure 11:
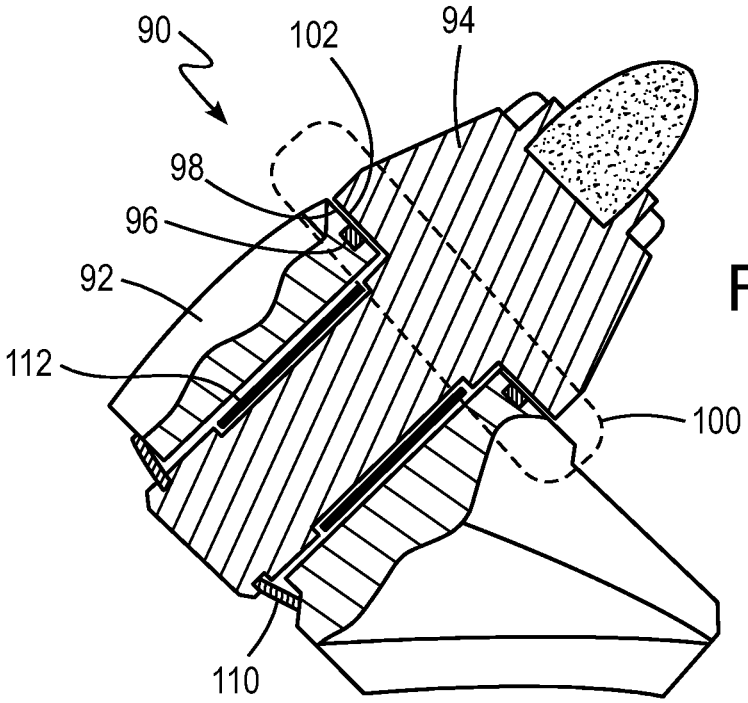
FIG. 11 shows an assembly without a hollow sleeve with the individual components assembled together.

The inclusion of the hollow sleeve in the assembly is optional. In such embodiments without the hollow sleeve, the cutting pick is mounted directly into the bore of the holder block. An exemplary embodiment of an assembly is illustrated in FIG. 11 in an assembled state. The assembly 90 comprises a holder block 92 having a first bore extending rearwardly from a front face and a cutting pick 94 with the shank of the cutting pick inserted into the first bore of the holder block 92 to mount the cutting pick 94 in the holder block 92. The cutting pick 94 includes a cutting head at a front end with a cutting tip, a shank at a rear end and a shoulder at a transition between the front end and the shank, the shoulder including a rearwardly oriented surface. A first cemented carbide wear element 96 is press fit into a first recess in the front face 98 of the holder block 92.

The front face of the holder block and the rearwardly oriented surface of the shoulder meet at an interface 100. The interface includes the first cemented carbide wear element 96 contacting the rearwardly oriented surface 102 of the shoulder.

To retain the cutting pick 94 in the holder block 92, a retaining device can be used. FIG. 11 illustrates two examples for a retaining device, although others can be used alone or in combination. The first example of a retaining device is a retaining clip 110 attached to the shank of the cutting pick 94. The second example of a retaining device is a compressible sleeve 112 in a slot along the shank of the cutting pick 94 and pressing outward against the surface of the bore in the holder block 92.

Although described in connection with preferred embodiments thereof, it will be appreciated by those skilled in the art that additions, deletions, modifications, and substitutions not specifically described may be made without department from the spirit and scope of the invention as defined in the appended claims.

The disclosures in U.S. provisional patent application No. 61/054,500, from which this application claims priority, are incorporated herein by reference.

What is claimed is:

1. An assembly comprising:

a holder block having a first bore extending rearwardly from a forwardly oriented front face;

a cutting pick including a cutting head at a front end with a cutting tip, a shank at a rear end and a shoulder at a transition between the front end and the shank, the shoulder including a rearwardly oriented surface; and a hollow sleeve mounted in the first bore of the holder block to receive the shank of the cutting pick, the hollow sleeve including, at a forward end, a forwardly oriented face and a radially extending shoulder with a rearwardly oriented surface and, at a rearward end, a shank defining a longitudinal axis, wherein the shank of the cutting pick is inserted into the hollow sleeve, wherein the front face of the holder block and the rearwardly oriented surface of the shoulder of the hollow sleeve meet at a first interface and the forwardly oriented face of the hollow sleeve and the rearwardly oriented surface of the shoulder of the cutting pick meet at a second interface, wherein at least one of the first interface and the second interface includes a plurality of wear elements press fit into recesses in the forwardly oriented face, and wherein the wear elements are rings.

2. The assembly of claim 1, wherein the first interface includes the first set of wear elements and the recesses are in the forwardly oriented front face of the holder block.

3. The assembly according to claim 1, wherein the wear elements directly contact a rearwardly oriented surface of the shoulder of the hollow sleeve.

4. The assembly as in claim 1, wherein the second interface includes a plurality of wear elements press fit into recesses in the forwardly oriented face of the hollow sleeve.

5. The assembly of claim 4, wherein the wear elements directly contact a rearwardly oriented surface of the shoulder of the cutting pick.

6. The assembly as in claim 1, wherein the wear elements are formed from cemented carbide.

7. The assembly as in claim 1, wherein the wear elements are a plurality of discreet wear elements.

8. An assembly comprising:

a holder block having a first bore extending rearwardly from a front face;

a cutting pick including a cutting head at a front end with a cutting tip, a shank at a rear end and a shoulder at a transition between the front end and the shank, the shoulder including a rearwardly oriented surface; and a first cemented carbide wear element press fit into a first recess in the front face of the holder block, wherein the shank of the cutting pick is inserted into the first bore of the holder block to mount the cutting pick in the holder block, wherein the front face of the holder block and the rearwardly oriented surface of the shoulder meet at an interface, and wherein the wear elements are rings.

9. The assembly of claim 8, comprising a plurality of spaced apart cemented carbide wear elements press fit into a recess in the front face of the holder block.

10. The assembly according to claim 8, wherein the wear elements are a plurality of discreet wear elements and wherein the wear elements directly contact the rearwardly oriented surface of the shoulder of the cutting pick.

11. A machine for mining, excavating, tunneling, road planing and/or construction comprising:

a rotatable element; and the assembly as in claim 1 mounted on the rotatable element.

12. A method of manufacturing an assembly, comprising:

forming a holder block having a first bore extending rearwardly from a front face;

forming a cutting pick including a cutting head at a front end with a cutting tip, a shank at a rear end and a shoulder at a transition between the front end and the shank, the shoulder including a rearwardly oriented surface;

forming a hollow sleeve mounted in the first bore of the holder block to receive the shank of the cutting pick, the hollow sleeve including, at a forward end, a radially extending shoulder with a forwardly oriented face and a rearwardly oriented surface and, at a rearward end, a shank defining a longitudinal axis; and at least one of (a) press fitting a first set of wear elements including cemented carbide bodies into recesses in a front face of the holder block, and (b) press fitting a second set of wear elements including cemented carbide bodies into recesses in a forwardly oriented face of the hollow sleeve, wherein the wear elements are rings.

13. The method of claim 12, wherein at least one of the holder block, the cutting pick and the hollow sleeve is heat treated subsequent to press fitting the wear elements.

14. The method of claim 12, wherein the first set of wear elements directly contact a rearwardly oriented surface of the shoulder of the hollow sleeve.

15. The method of claim 12, wherein the second set of wear elements directly contact a rearwardly oriented surface of the shoulder of the cutting pick.

* * * * *